US010820724B2

(12) United States Patent
Cain et al.

(10) Patent No.: US 10,820,724 B2
(45) Date of Patent: Nov. 3, 2020

(54) COSMETIC DISPENSARY

(71) Applicant: Love Line Inc., Corrales, NM (US)

(72) Inventors: Gail P. Cain, Corrales, NM (US); Andrew D. Cain, Corrales, NM (US)

(73) Assignee: LoveLine Inc., Corrales, NM (US)

( * ) Notice: Subject to any disclaimer, the term of this patent is extended or adjusted under 35 U.S.C. 154(b) by 0 days.

(21) Appl. No.: 16/657,413

(22) Filed: Oct. 18, 2019

(65) Prior Publication Data

US 2020/0121099 A1 Apr. 23, 2020

Related U.S. Application Data

(60) Provisional application No. 62/748,881, filed on Oct. 22, 2018.

(51) Int. Cl.

| | |
|---|---|
| ***A47F 7/00*** | (2006.01) |
| ***A45D 44/02*** | (2006.01) |
| ***A47F 3/00*** | (2006.01) |
| ***A47F 3/14*** | (2006.01) |
| ***B65B 3/04*** | (2006.01) |

(52) U.S. Cl.

CPC ..... *A47F 7/0028* (2013.01); *A45D 44/02* (2013.01); *A47F 3/001* (2013.01); *A47F 3/14* (2013.01); *B65B 3/04* (2013.01)

(58) Field of Classification Search

CPC ..... A47F 7/0021; A47F 7/0028; A47F 3/001; A47F 3/14; A45D 44/02; B65B 3/04

See application file for complete search history.

(56) References Cited

U.S. PATENT DOCUMENTS

| | | | | | |
|---|---|---|---|---|---|
| 2,637,299 | A * | 5/1953 | Salkey | A45C 11/34 | 206/214 |
| 3,760,973 | A | 9/1973 | Canning et al. | | |
| D239,999 | S | 5/1976 | Christian | | |
| 3,987,892 | A | 10/1976 | Killy | | |
| D263,447 | S | 3/1982 | Brown | | |
| D315,297 | S | 3/1991 | Campbell | | |
| D316,671 | S | 5/1991 | Rohmeder | | |
| 5,057,282 | A * | 10/1991 | Linder | B01L 9/543 | 206/366 |
| 5,076,444 | A * | 12/1991 | Syms | A47F 3/10 | 211/163 |
| D333,758 | S | 3/1993 | Lillelund | | |
| 5,714,127 | A * | 2/1998 | DeWitt | B01J 19/0046 | 422/130 |
| 5,725,109 | A * | 3/1998 | Moulton | B01L 9/06 | 211/73 |
| D424,932 | S | 5/2000 | Seidler | | |

(Continued)

*Primary Examiner* — Daniel J Rohrhoff

(74) *Attorney, Agent, or Firm* — C. Tumey Law Group PLLC

(57) ABSTRACT

Systems, methods, and devices for dispensing a cosmetic. A product packaging system comprises a counter and a cosmetic product packaging. The cosmetic product packaging comprises a housing. The housing includes an upper surface, a bottom surface, and lateral sides connecting the upper surface and the bottom surface. Bores are formed in the upper surface. The cosmetic product packaging system also includes receptacles that are disposable in the bores, and a base assembly that supports the housing. The base assembly comprises a compartment including a light source. The cosmetic product packaging may be positioned on the counter.

20 Claims, 5 Drawing Sheets

(56) References Cited

U.S. PATENT DOCUMENTS

| | | | | |
|---|---|---|---|---|
| D478,808 | S | 8/2003 | Dubiel et al. | |
| 7,731,039 | B1 * | 6/2010 | Minger | A47F 7/0078 211/88.01 |
| 8,808,650 | B1 * | 8/2014 | Iqbal | B01L 9/06 422/562 |
| 9,101,167 | B2 * | 8/2015 | Fath | B65D 5/542 |
| 2005/0225965 | A1 * | 10/2005 | Jiang | A47F 3/001 362/133 |
| 2008/0164182 | A1 * | 7/2008 | Pender | A47F 7/0028 206/581 |
| 2009/0272703 | A1 * | 11/2009 | Conway, Jr. | A47F 3/14 211/85.4 |
| 2011/0204009 | A1 * | 8/2011 | Karan | A47F 3/001 211/59.2 |
| 2016/0064995 | A1 * | 3/2016 | Schwalbach | A47F 10/00 320/108 |
| 2020/0146422 | A1 * | 5/2020 | Kamboj | A47F 7/0028 |

* cited by examiner

COSMETIC DISPENSARY

BACKGROUND

Cosmetics may include substances or products that can be applied to a wearer's body for a variety of different functions, for example, to alter appearance or add a fragrance. Cosmetics are often stored in packaging, such as a housing or container. Suitable packaging may include bottles or tubes for holding the cosmetic. Consumers often possess a number of different cosmetics that may be stored in a variety of different packages of various designs and materials of construction. The various packages can often clutter the consumer's storage area for these cosmetics, thus providing a less than desirable aesthetic appearance. In addition, the cosmetics are also often provided in packaging that is disposable, adding to the already considerable problems with respect to waste disposal.

SUMMARY

In an exemplary embodiment, a cosmetic product packaging system comprises a counter and a cosmetic product packaging. The cosmetic product packaging comprises a housing. The housing includes an upper surface, a bottom surface, and lateral sides connecting the upper surface and the bottom surface. Bores are formed in the upper surface. The cosmetic product packaging system also includes receptacles that are disposable in the bores, and a base assembly that supports the housing. The base assembly comprises a compartment including a light source. The cosmetic product packaging may be positioned on the counter.

In another exemplary embodiment, a cosmetic product packaging system comprises a counter; a cabinet; and a cosmetic product packaging. The cosmetic product packaging comprises a housing that includes an upper surface, a bottom surface, and lateral sides connecting the upper surface and the bottom surface, wherein bores are formed in the upper surface. The cosmetic product packaging system also includes receptacles that are disposable in the bores, and a base assembly that supports the housing. The base assembly comprises a compartment including a light source. The cosmetic product packaging may be positioned on the counter. The cosmetic product packaging system also includes a cartridge comprising a cosmetic.

In another exemplary embodiment, a method for refilling a receptacle comprises retrieving a cartridge containing a cosmetic; removing a cap from the cartridge; and transferring the cosmetic from the cartridge to the receptacle. The receptacle may be positioned within a cosmetic product packaging that includes a housing comprising an upper surface, a bottom surface, and lateral sides connecting the upper surface and the bottom surface. Bores are formed in the upper surface. The receptacle is disposable in a bore. The cosmetic product packaging also includes a base assembly that supports the housing, wherein the base assembly comprises a compartment including a light source.

BRIEF DESCRIPTION OF THE DRAWINGS

These drawings illustrate certain aspects of some of the embodiments of the present disclosure and should not be used to limit or define the disclosure.

DETAILED DESCRIPTION

The present disclosure may generally relate to an eco-friendly retail space for dispensing cosmetics. Some embodiments include structures such as cabinets and counters to facilitate purchasing of cosmetics.

Customers can buy cosmetics that are packaged in reusable and refillable receptacles that are stored and displayed in cosmetic product packaging. The cosmetic product packaging can store multiple receptacles for cosmetics. Customers can refill their receptacles or may purchase refill cartridges that are paper packaged, biodegradable. The contents of the refill cartridge can be squeezed into the receptacles through a syringe like tip or nozzle.

Embodiments of the cosmetic product packaging transform the single bottle packaging that is the old standard to an innovative concept that is a practical, single unit. Advantageously, replacement or refills can be purchased, reducing waste and potentially even increasing consumer loyalty. Embodiments of the cosmetic product packaging may include a housing that is transparent and retains a plurality of receptacles for a cosmetic. In some embodiments, the cosmetic product packaging may further include a light source that can be used to illuminate the individual receptacles disposed in the housing. Embodiments may further include threaded engagement between the receptacles and the housing to retain the receptacles therein.

The term "cosmetic" as used here is intended to encompass, without limitation, any of a variety of products for beautifying, enhancing, cleansing, covering and/or medicinal compounds which may be applied to a wearer's body, or portion thereof, such as the face. Suitable products may include, but are not limited to, perfumes, colognes, make-up, skin cleansers, and body lotions, among others. Combinations of different cosmetic products may also be stored in the cosmetic product packaging. For example, each receptacle may include a different cosmetic. In addition, while this application is directed to cosmetic product packaging, it should be understood that the product packaging disclosed herein can have applicability in other industries, for example, medical, pharmaceutical, laboratory, and medical spas, among others. For example, the product packaging could be used to hold substances provided in these different industries.

Figure 1:
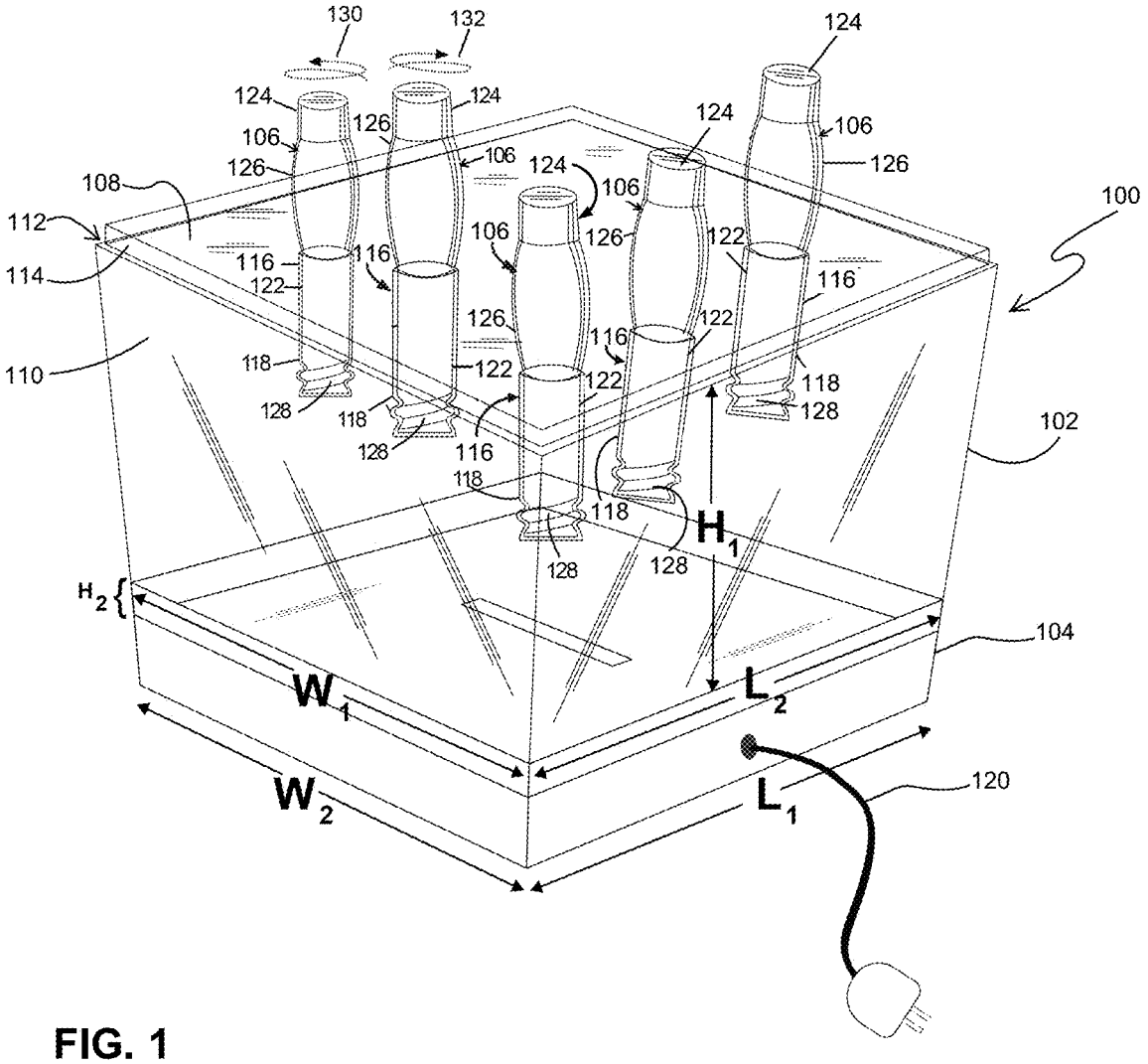
FIG. 1 illustrates a cosmetic product packaging in accordance with some embodiments of the present disclosure.

Referring now to FIG. 1, an example embodiment of cosmetic product packaging 100 is illustrated. As illustrated, cosmetic product packaging 100 may include housing 102, base assembly 104, and receptacles 106. In the illustrated embodiment, receptacles 106 may include a cosmetic and be disposed in housing 102. In some embodiments, housing 102 may be disposed on base assembly 104, which may include a light (e.g., light source 400 on FIG. 4) for illumination of the receptacles 106.

Housing 102 may include an upper surface 108 and lateral sides 110. As illustrated, upper surface 108 may include cut outs 112 around lateral edges 114 so that lateral edges 114 of upper surface 108 are not flush with lateral sides 110. While not shown, alternative embodiments may omit cut outs 112 so that lateral edges 114 may be flush with lateral sides 110. Housing 102 may further include a plurality of bores 116, which may be drilled, molded, or otherwise formed in housing 102. As illustrated, bores 116 may extend from upper surface 108 into an interior portion of the housing 102. In the illustrated embodiment, each of bores 116 includes threading 118, which is shown disposed at an end of each respective bore 116. However, it should be understood that the threading 118 is not required to be at the end, but rather can be positioned anywhere along the bores 116 for engagement with the receptacle 106. In some embodiments, the housing 102 may be transparent so that light rays may be transmitted through the housing 102, for example, so that a light source (e.g., light source 400 on FIG. 4) in base assembly 104 can illuminate receptacles 106. Housing 102 may include any of a variety of suitable transparent materials, including, but not limited to, glass and acrylic (or another suitable transparent thermoplastic material).

Housing 102 may have any suitable dimensions and/or shape. Without limitation, a suitable shape may include, but is not limited to, cross-sectional shapes that are circular, elliptical, triangular, rectangular, square, hexagonal, and/or combinations thereof. In examples, housing 102 may have a rectangular cross-section, such as the rectangular prism as illustrated. Housing 102 may be sized for holding receptacles 106. By way of example, housing 106 may have a height ($H_1$) of about 4 inches to about 24 inches, or about 6 inches to about 12 inches with similar ranges for width ($W_1$) and length ($L_1$). However, it should be understood that dimensions outside these ranges may also be suitable depending, for example, on the particular application.

Figure 3:
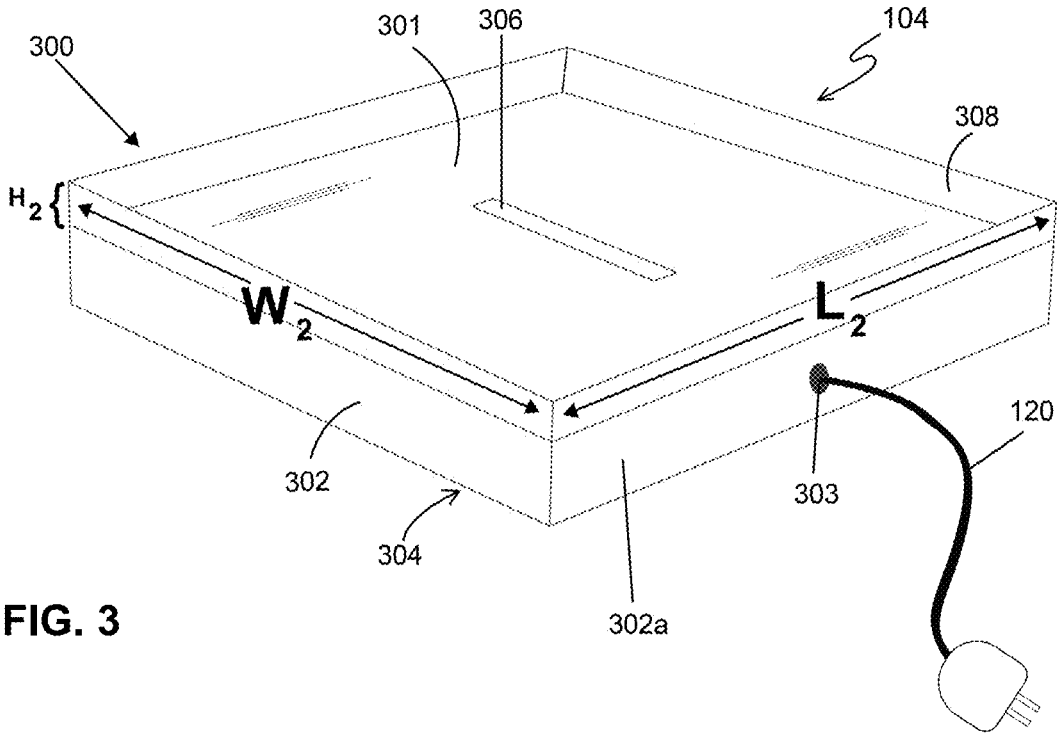
FIG. 3 illustrates a base assembly for the cosmetic product paging of FIGS. 1 and 2, in accordance with some embodiments of the present disclosure.
Figure 4:
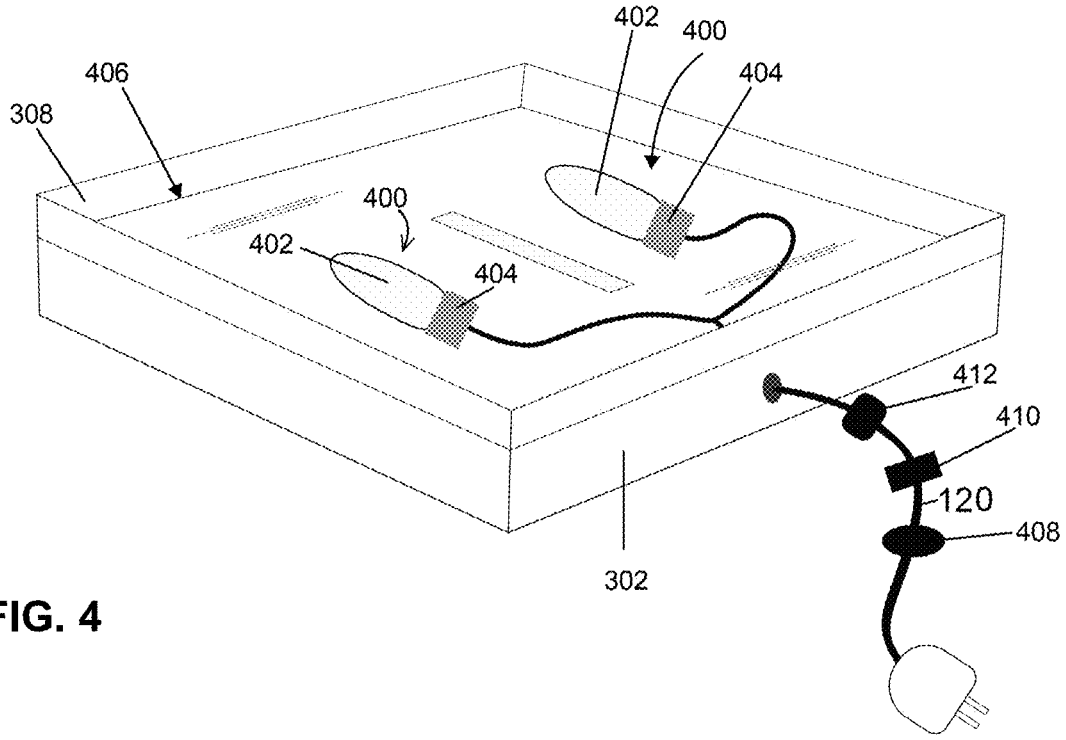
FIG. 4 illustrates another base assembly for the cosmetic product paging of FIGS. 1 and 2, in accordance with some embodiments of the present disclosure.

In the illustrated embodiment, housing 102 is disposed on base assembly 104. Base assembly 104 may be configured to support housing 102. For example, base assembly 104 may include height ($H_2$), width ($W_2$), length ($L_2$), and/or shape(s) that may be similar to the dimensions and shape(s) of the housing 102. FIGS. 3 and 4 are example embodiments of the base assembly 104 illustrated in more detail.

In certain embodiments, the housing 102 may form a seal (e.g., a fluid seal) with the base assembly 104. In some embodiments the housing is removable from the base assembly 104 to allow for cleaning or access to various components of the cosmetic product packaging 100. An electrical cable 120 may be coupled to base assembly 104. Electrical cable 120 may couple the base assembly 104 (and light source (e.g., light source 400 on FIG. 4) not shown) to a power source (not shown) for supplying power to the light source.

Embodiments of cosmetic product packaging 100 may further comprise receptacles 106. Receptacles 106 may be disposed in bores 118 of housing 102. In the illustrated embodiment, receptacles 106 may include vial portion 122 and cap 124. Cap 124 may function as protective cover for retaining the cosmetic in vial portion 122. Vial portion 122 may extend into bores 118. Vial portion 122 may include an enlarged portion 126. Vial portion 122 may include threading 128, which is shown disposed at an end of each respective vial portion 122. However, it should be understood that the threading 128 is not required to be at the end, but rather can be positioned anywhere along the vial portions 122 for engagement with the corresponding threading 118 within bores 116. For insertion of receptacles 106 into housing 110, the receptacles 106 may be inserted into the bores 116 and then twisted, for example, in the direction shown by arrow 130, upon engagement with threading 118 of bores 116, to secure the receptacles 106. For removal, the receptacles 106 may be rotated in the opposite direction, shown by arrow 132 to disengage the threading 118.

Figure 2:
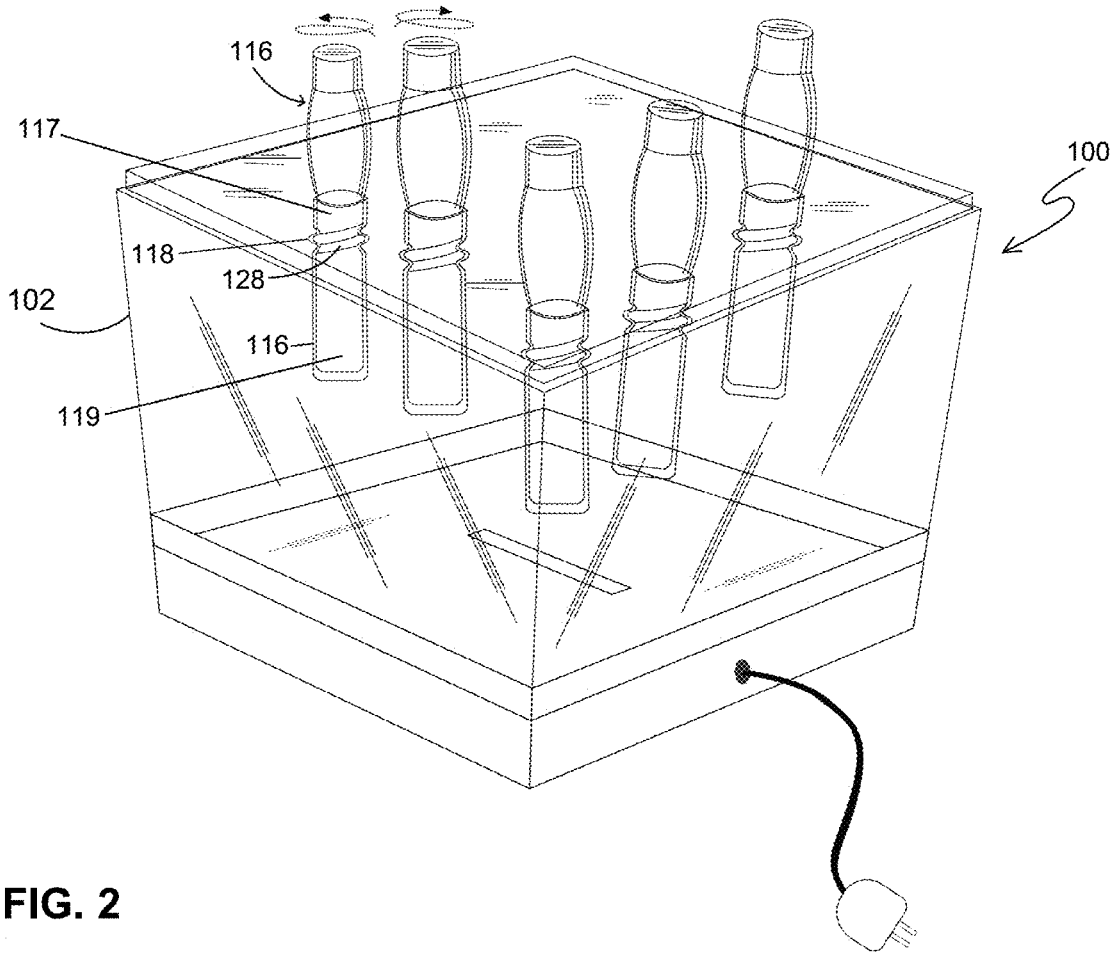
FIG. 2 illustrates another cosmetic product packaging in accordance with some embodiments of the present disclosure.

Referring now to FIG. 2, another example embodiment of cosmetic product packaging 100 is illustrated. As illustrated, receptacles 106 may be disposed in housing 102. In the illustrated embodiment, threading 128 on receptacles 106 is in engagement with corresponding threading 118 of bores 116. However, instead of being disposed at the end of receptacles 106 and bores 116, respectively, the threading 128 on receptacles 106 and threading 118 along bore 116 may be positioned between proximal ends 117 and distal ends 119 of the bores 116, as shown. In certain embodiments, the threading 118 and the threading 128 may be adjacent to the proximal ends 117, as shown.

Referring now to FIG. 3, an example embodiment of base assembly 104 is illustrated in more detail. As illustrated, base assembly 104 may include sides 302 and bottom 304. The sides 302 may extend (e.g., upward) from the bottom 304, as shown. A side **302*a* may include an opening 303 to allow passage of the electrical cable 120 into a compartment (e.g., a compartment 406 as shown on FIG. 4) or an interior of the base assembly 104**, as shown.

In some embodiments, a cover 300 may be removably disposed over the sides 302, as shown. The cover 300 may include a wall 308 extending above and along a perimeter of a surface 301 of the cover 300, as shown. The wall 308 may extend (e.g., upward) from the surface 301 to assist in retaining housing 102 (e.g., shown on FIGS. 1 and 2) on the cover 300 while the cover 300 is attached to the sides 302 of the base assembly 104. The wall 308 may align with the sides 302 of the base assembly 104, as shown.

In the illustrated embodiment, cover 300, sides 302, and bottom 304 may be solid (or non-transparent) so that light may be not emitted there through. The height ($H_w$) of the wall 308 may range from 10% to 100% of the height of a side 302. The length ($L_w$) and width ($W_w$) may be similar to $L_1$, $L_2$, $W_1$, and $W_2$, respectively. In certain embodiments, the cover 300 may be removable from the sides 302. The cover 300 may form a seal with the sides 302 to prevent contaminants such as dust from contacting components (e.g., light sources 400 as shown on FIG. 4) covered by the cover 300.

However, cover 300 may include an opening 306, which may be in the form of a slot, for example. Opening 306 may allow light emitted from inside base assembly 104 to be emitted there from. For example, light emitted from inside base assembly 104 may travel through opening 306 in cover 300 and then through housing 102 to illuminate receptacles 106 (with additional reference to FIGS. 1 and 2). As previously described, base assembly 104 may further include an electrical cable 120 for powering a light source (e.g., light source 400 on FIG. 4) disposed inside base assembly 104.

Referring now to FIG. 4, another example embodiment of base assembly 104 is illustrated. FIG. 4 illustrates a cut away view of FIG. 3. Specifically, the cover 300 is not shown to allow a view of components disposed within the base assembly 104 and below the cover 300 within the compartment 406, as shown.

In certain embodiments, the compartment 406 may be bound by the cover 300 (e.g., inner side (not shown) of the cover 300), the sides 302, and the bottom 304. The base assembly 104 may be an open top container. As shown, a pair of light sources 400 are disposed in the compartment 406 of the base assembly 104. As illustrated, the light sources 400 may be disposed below the cover 300. In the illustrated embodiment, cover 300 may be transparent for allowing light to pass there through. Light sources 400 may include any suitable source of light, such as a source of visible light with wavelengths ranging from 390 nanometers to 700 nanometers. In some embodiments, light sources 400 may each include a bulb 402 and a socket 404. Suitable bulbs 404 may include incandescent bulbs as well as light emitting diodes (LED) bulbs. Electrical cable 120 may be coupled to light sources 400, for example, thorough sides 302 to provide power to light sources 400. In operation, light emitted from light sources 400 may travel through cover 300 of base assembly 104 and then through housing 102 to illuminate receptacles (with additional reference to FIGS. 1 and 2). In certain embodiments, the electrical cable 120 may be coupled to a power switch 408 and/or a light dimmer 410. The electrical cable 120 can also be coupled to a controller 412 (e.g., a programmable logic controller) to control light effects such as light pulsing, light intensity, duration of a lighting cycle (e.g., lights are on or off during a programmed time period).

Figure 5:
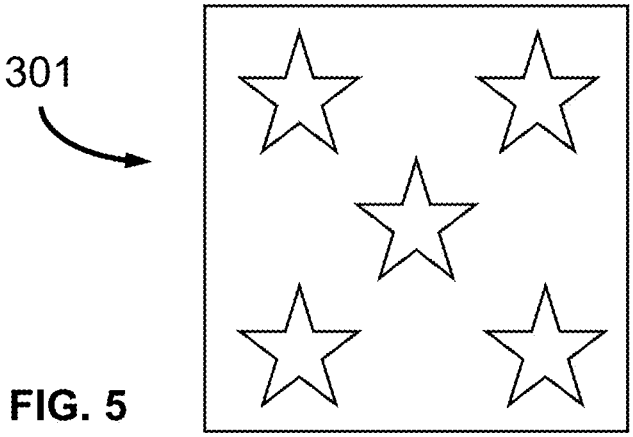
FIG. 5 illustrates a lighting feature of the cosmetic product packaging in accordance with some embodiments of the present disclosure.

FIG. 5 illustrates a top view of the surface 301 of the cover 300 in accordance with a particular embodiment of the present disclosure. As shown, the surface 301 may include a gobo 500 or template to allow light through in particular patterns to provide visual effects.

Figure 6:
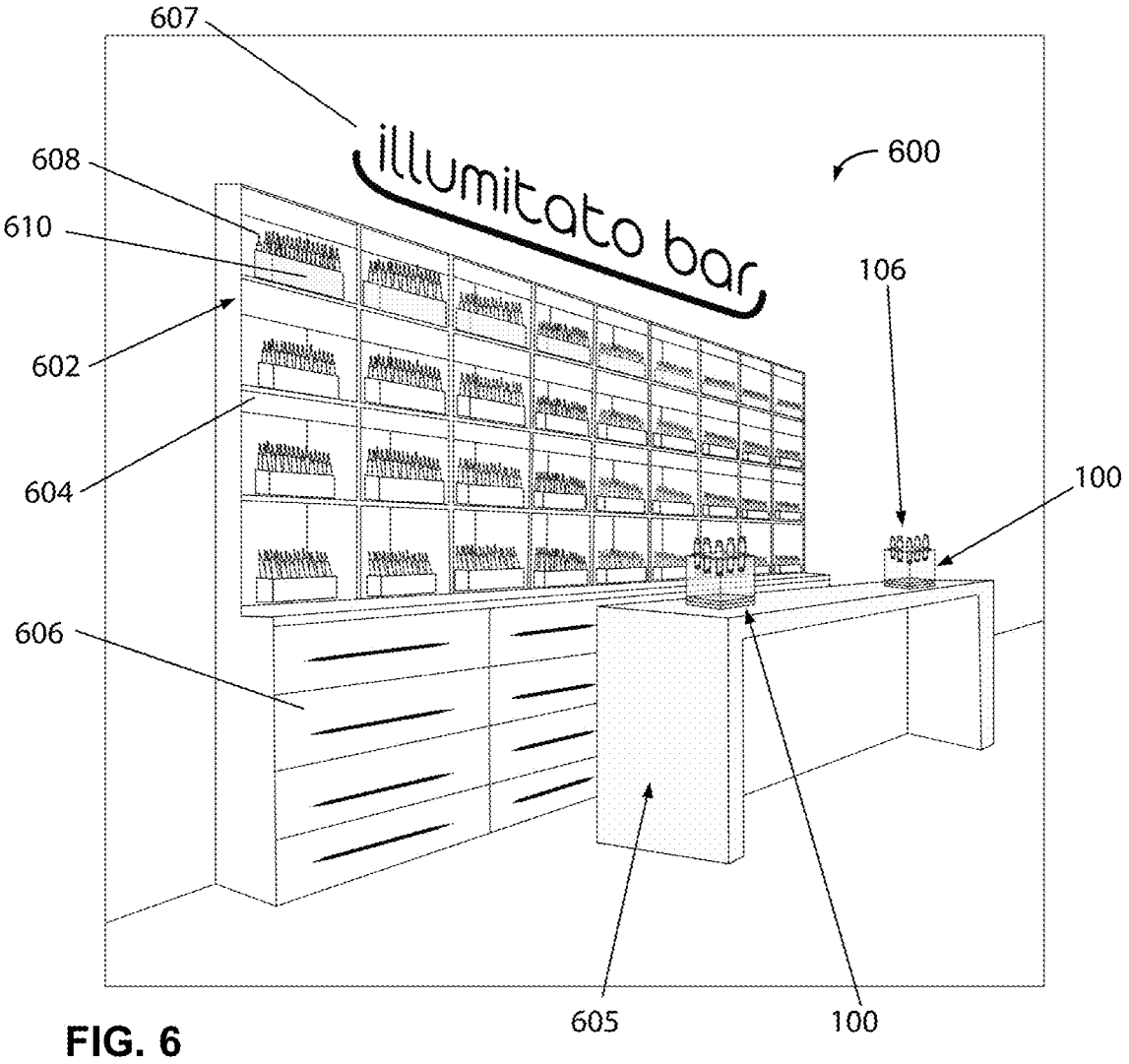
FIG. 6 illustrates a retail space for dispensing cosmetics in accordance with some embodiments of the present disclosure.

FIG. 6 illustrates a cosmetic dispensary or a system 600 for dispensing at least one cosmetic product packaging 100 in accordance with a particular embodiment of the present disclosure. The system 600 may be a point of purchase or a retail space for cosmetics that is eco-conscious. Specifically, customers may buy the reusable and refillable receptacles 106 and/or cartridges 608 containing a cosmetic to refill a depleted receptacle 106.

As shown, the system 600 may includes structures to support at least one cosmetic product packaging 100. Without limitation, these structures may include a cabinet 602 and/or a counter 605 (or a table, a countertop, and similar structures). In certain embodiments, the counter 605 may be separate from the cabinet 602.

The cabinet 602 may include a shelf 604 for storing receptacles 106. It should be noted that more than one shelf 604 and cabinet 602 may be provided, as shown. The cabinet 602 may also include at least one drawer 606. Each shelf 604 and/or drawer 606 may contain at least one cartridge 608 as best shown on FIG. 7. The cartridges 608 may be disposed within boxes 610, as shown. The cartridges 608 may contain a cosmetic similar to what is contained in the receptacles 106. At least one cosmetic product packaging 100 may be positioned on the counter 605, as shown. In certain embodiments, a neon light 607 may be positioned adjacent to the cabinet 602, as shown.

Figure 7:
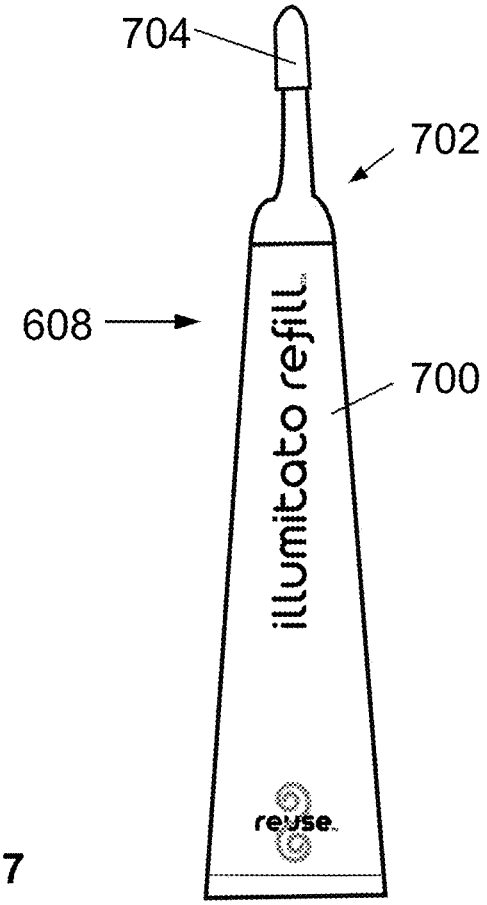
FIG. 7 illustrates a cartridge containing a cosmetic in accordance with some embodiments of the present disclosure.

FIG. 7 illustrates a cartridge 608 in accordance with a particular embodiment of the present disclosure. Each cartridge 608 may be biodegradable. For example, the cartridge 608 may be constructed of paper. The cartridge 608 may include storage 700 (e.g., a pouch) fluidly coupled to a nozzle 702. The storage 700 may include a cosmetic. A cap 704 may be removable disposed on a distal end of the nozzle 702, as shown. The nozzle 702 and the cap 704 may also be biodegradable (e.g., cardboard). In certain embodiments, the cartridge 608 may be removed from its location (e.g., the cabinet 602), then the cap 704 may be removed to allow a user to squeeze the cosmetic into a receptacle 106 thereby refilling the receptacle 106 with the selected cosmetic.

The present disclosure is illustrated herein by example, and various modifications may be made by a person of ordinary skill in the art. It is believed that the operation and construction of the present disclosure will be apparent from the foregoing description. While the apparatus and methods shown or described above have been characterized as being preferred, various changes and modifications may be made therein without departing from the spirit and scope of the disclosure as defined in the following claims.

What is claimed is:

1. A cosmetic product packaging system comprising:
a counter; and
a cosmetic product packaging, the cosmetic product packaging comprising:
a housing, the housing comprising an upper surface, a bottom surface, and lateral sides connecting the upper surface and the bottom surface, wherein bores are formed in the upper surface;
receptacles, wherein the receptacles are disposable in the bores; and
a base assembly that supports the housing, wherein the base assembly comprises a compartment including a light source;
wherein the cosmetic product packaging is positioned on the counter.

2. The cosmetic product packaging system of claim 1, further comprising a cabinet.

3. The cosmetic product packaging system of claim 2, wherein the cabinet comprises a shelf.

4. The cosmetic product packaging system of claim 3, further comprising a cartridge positioned on the shelf, the cartridge comprising a cosmetic.

5. The cosmetic product packaging system of claim 4, wherein the cartridge is biodegradable.

6. The cosmetic product packaging system of claim 4, wherein the cartridge is made of paper.

7. The cosmetic product packaging system of claim 2, further comprising a neon light adjacent to the cabinet.

8. The cosmetic product packaging system of claim 2, further comprising at least one drawer.

9. The cosmetic product packaging system of claim 1, further comprising a cabinet, wherein the cabinet comprises at least one shelf and at least one drawer.

10. The cosmetic product packaging system of claim 1, further comprising a gobo positioned over the light source.

11. A cosmetic product packaging system comprising:
a counter;
a cabinet; and
a cosmetic product packaging, the cosmetic product packaging comprising:
a housing, the housing comprising an upper surface, a bottom surface, and lateral sides connecting the upper surface and the bottom surface, wherein bores are formed in the upper surface;
receptacles, wherein the receptacles are disposable in the bores; and
a base assembly that supports the housing, wherein the base assembly comprises a compartment including a light source;
a cartridge comprising a cosmetic;

wherein the cosmetic product packaging is positioned on the counter.

12. The cosmetic product packaging system of claim 11, wherein the cartridge is biodegradable.

13. The cosmetic product packaging system of claim 11, wherein the cartridge is made of paper.

14. The cosmetic product packaging system of claim 11, wherein the cartridge comprises a nozzle.

15. The cosmetic product packaging system of claim 14, wherein the nozzle is biodegradable.

16. The cosmetic product packaging system of claim 15, further comprising a cap disposed on the nozzle.

17. The cosmetic product packaging system of claim 16, wherein the cap is biodegradable.

18. A method for refilling a receptacle, comprising:

retrieving a cartridge containing a cosmetic;

removing a cap from the cartridge; and transferring the cosmetic from the cartridge to the receptacle, the receptacle positioned within a cosmetic product packaging, the cosmetic product packaging comprising:

a housing, the housing comprising an upper surface, a bottom surface, and lateral sides connecting the upper surface and the bottom surface, wherein bores are formed in the upper surface, wherein the receptacle is disposable in a bore; and a base assembly that supports the housing, wherein the base assembly comprises a compartment including a light source.

19. The method of claim 18, further comprising positioning the cosmetic product packaging on a counter.

20. The method of claim 18, further comprising retrieving the cartridge from a shelf.

* * * * *